US008522403B2

(12) United States Patent
Hayashi

(10) Patent No.: US 8,522,403 B2
(45) Date of Patent: Sep. 3, 2013

(54) BUTTON AS WELL AS BUTTON BODY AND FIXTURE FOR SUCH A BUTTON

(75) Inventor: Daisuke Hayashi, Wuppertal (DE)

(73) Assignee: YKK Corporation (JP)

( * ) Notice: Subject to any disclaimer, the term of this patent is extended or adjusted under 35 U.S.C. 154(b) by 183 days.

(21) Appl. No.: 12/635,891

(22) Filed: Dec. 11, 2009

(65) Prior Publication Data

US 2010/0146741 A1 Jun. 17, 2010

(30) Foreign Application Priority Data

Dec. 11, 2008 (EP) ..... 08021555

(51) Int. Cl.
*A44B 1/28* (2006.01)

(52) U.S. Cl.
USPC ..... 24/114.4; 24/114.05; 24/90.1; 24/104; 24/101 R

(58) Field of Classification Search
USPC ..... 24/114.4, 114.05, 94, 96, 90.1, 104, 24/101 R
See application file for complete search history.

(56) References Cited

U.S. PATENT DOCUMENTS 1,646,053 A * 10/1927 Clark ..... 24/95
2,299,494 A * 10/1942 Purinton ..... 24/101 R
5,189,762 A 3/1993 Giancaspro
5,575,043 A * 11/1996 Candotti ..... 24/114.4
6,266,853 B1 * 7/2001 Ho ..... 24/92
7,251,865 B2 * 8/2007 Takamura et al. ..... 24/114.4

FOREIGN PATENT DOCUMENTS

EP 0695517 A 2/1996
EP 1541050 A1 7/2003
FR 2633811 A 1/1990

* cited by examiner

*Primary Examiner* — Robert J Sandy
*Assistant Examiner* — Michael Lee
(74) *Attorney, Agent, or Firm* — Kilpatrick Townsend & Stockton LLP

(57) ABSTRACT

A button is provided. A fixture fixes a button body to a support from an opposite side to the button body with the support therebetween. The button body includes a collar, a shaft protruding from the collar and an insert hole for the fixture to be inserted therein. An outer circular wall and an inner circular wall are formed at a tip end of the shaft separately from each other with a gap therebetween. The outer circular wall defines an outer periphery of the shaft and at least one protrusion for fixing the support thereon is formed at an upper surface of the outer circular wall. The inner circular wall defines an inner periphery of the insert hole. The protrusion protrudes relative to an upper surface of the inner circular wall and the gap is recessed relative to the upper surface of the inner circular wall.

12 Claims, 3 Drawing Sheets

BUTTON AS WELL AS BUTTON BODY AND FIXTURE FOR SUCH A BUTTON

The disclosure of European Patent Application No. 08021555.1 filed on Dec. 11, 2008 including specification, drawings and claims are incorporated herein by reference.

BACKGROUND

The present invention relates to a button comprising a button body and a fixture for fixing said button body to a support from the opposite side to the button body with the support therebetween, said button body having an insert hole defined by a wall, for the fixture to be inserted therein, and at least one protrusion for fixing on said support.

Buttons of the above-mentioned kind are known, e.g. from EP 1 541 050 A1. With conventional buttons, when the fixture is inserted into the insert hole the insert hole and thereby the wall defining said hole is urged to expand, since the part of the fixture to be inserted has a larger outer diameter as compared to the inner diameter of the insert hole. With the conventional button, however, there is strong resistance against such an expansion because said protrusion is positioned on said wall defining said insert hole. In other words, if said wall is to be expanded, said protrusion must be expanded (lengthened) as well.

SUMMARY

It is an object of the present invention to enhance the button known from EP 1 541 050 A1 so that the resistance against expansion of the wall defining the insert hole is reduced.

According to the present invention, the above object is achieved by a gap between said protrusion and said wall defining said insert hole.

Resulting from said gap, the wall defining the insert hole can be expanded when the fixture is inserted into the insert hole, without simultaneously expanding the protrusion, resulting in that the overall resistance against said extension is reduced. Thereby, it is easier to mount the button by inserting the fixture into said insert hole. The shock given to the button body by inserting the fixture into the insert hole is reduced by said gap. The gap compensates for the size of the material that gets taken into the insert hole when the fixture is mounted.

Preferably, the outer diameter of said insert hole defining wall increases in at least one axial section in the direction from a lower side of the button body facing the support to an upper side of the button body.

Thereby, the resistance against expansion is lowered, while sufficient stability of the button body is simultaneously guaranteed.

While the button body may have any contour, it is preferred that the outer contour of the insert hole defining wall is conical in at least one axial section in the direction from a lower side of the button body facing the support to an upper side of the button body.

Preferably, said protrusion has a circular cross section. This results in advantages during production.

Moreover, said protrusion preferably has a conical head portion. Once again, this results in advantages during production. Furthermore, this contour has advantages regarding the attachment to the support.

According to a preferred embodiment of the invention, the cross section of the insert hole is increasing, particularly stepwise, from a lower side of the button body facing the support to an upper side of the button body. This makes the connection stronger.

To this end, it is preferable that the depth of the gap essentially corresponds to the axial length of the lowest (and smallest) part of the insert hole or is even larger, because in this part of the button body the expansion of the wall is expected to be largest.

According to a further preferred embodiment of the invention, the fixture has at least one protrusion for fixing on said support.

Said protrusion preferably has pyramid form.

According to an even more preferred embodiment, said protrusion of said fixture and said protrusion of said button body cooperate to clasp said support when mounted. It is clear that they need to have certain positions relative to one another.

More preferably, said protrusion of said fixture is positioned radially inside or radially outside said protrusion of said button body, when mounted. Thereby, radial or lateral movement is prevented, particularly with view to thin material supports.

Preferably, means for preventing the fixture from rotating relative to the button body is provided. Thereby, it is possible to make sure that the protrusion of the button body on the one hand and the protrusion of the fixture on the other hand are mounted in the correct relative position to guarantee the above functions.

To this end, said rotation-preventing means comprises at least one protrusion, particularly a rib or a tread.

The present invention does not refer to the above button only, but also to a button body and to a fixture of such a button.

BRIEF DESCRIPTION OF THE DRAWINGS

In the following, the invention is explained referring to a preferred embodiment. To this end, reference is made to the drawings, of which

DETAILED DESCRIPTION OF EXEMPLARY EMBODIMENTS

Figure 1A:
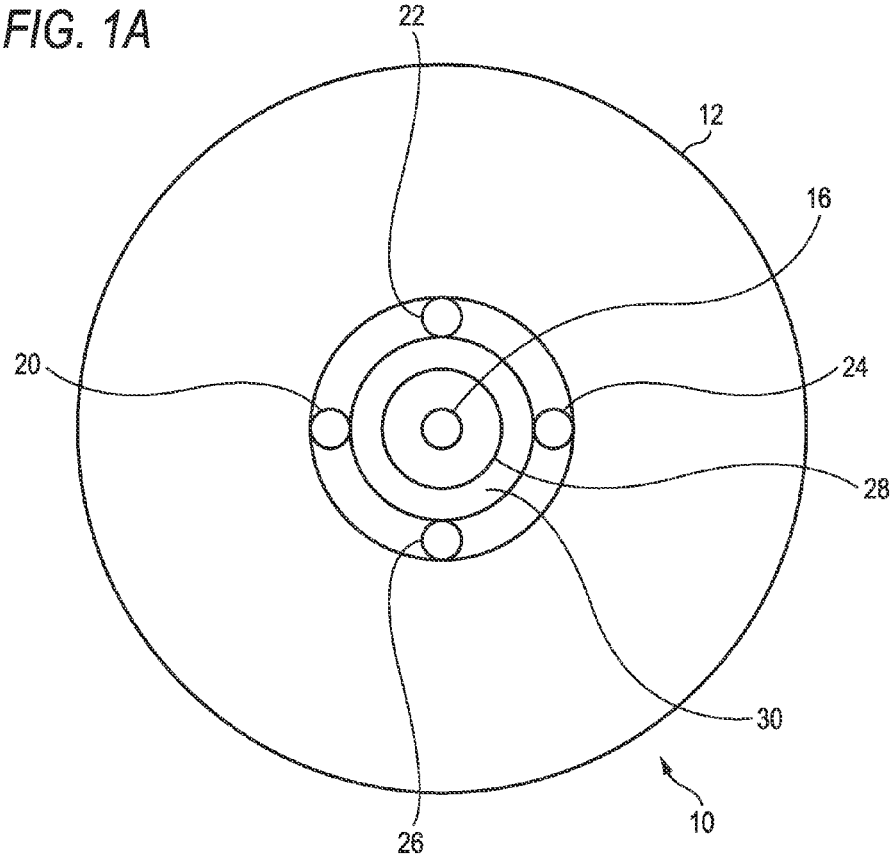
FIG. 1A is a plan view of a button body according to a preferred embodiment.
Figure 1B:
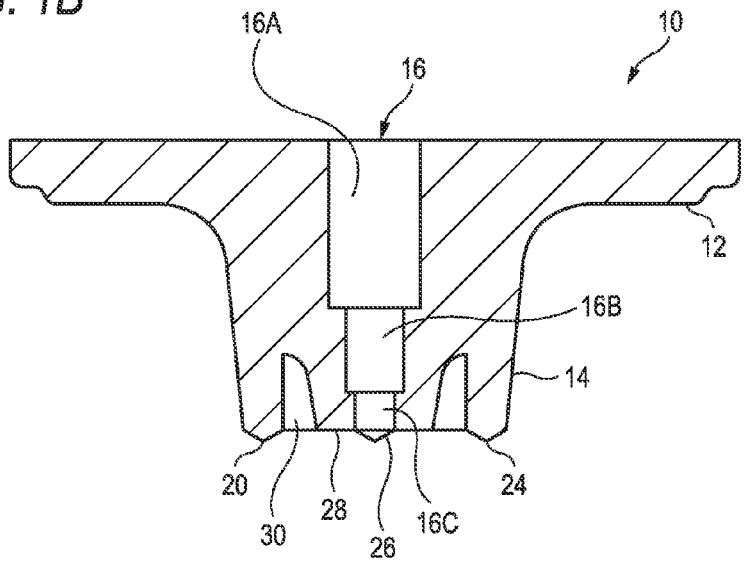
FIG. 1B is a sectional view of the button body shown in FIG. 1A.

As shown in FIGS. 1A and 1B, a button body 10 includes a collar 12, a shaft 14 and an insert hole 16 for a fixture 18 to be inserted therein. Button body 10 is made of a material allowing to expand the external form of shaft 14 to be out of position when fixture 18 is inserted into insert hole 16, such as synthetic resin as used in this embodiment.

Insert hole 16 has a step-like form, with the inner diameter becoming smaller step by step toward an end face facing fixture 18. In this embodiment, insert hole 16 includes a first hole 16A, a second hole 16B with the inner diameter being smaller than first hole 16A, and a third hole 16C with the inner diameter being smaller than that of second hole 16B arranged sequentially on the three steps as described above. In some embodiments, first hole 16A is referred to as a first part, and second hole 16B and third hole 16C together are referred to as a second part. As shown in FIG. 1B, the second part extends from a bottom edge of first part 16A to the end face (also referred to as the lower portion) of the button body 10 and the diameter of the second part is smaller than the diameter of the first part. In some embodiments, the diameter of the second part decreases in step fashion as described above and as shown in FIG. 1B.

Protrusions 20, 22, 24, 26 are formed integrally with shaft 14. They have circular cross sections and a conical head portion. Between said protrusions 20, 22, 24, 26 and a wall 28 defining insert hole 16, there is a gap 30, allowing wall 28 to expand when fixture 18 is inserted into insert hole 16. Wall 28 has a conical outer contour where it defines third insert hole 16C and partly where it defines second insert hole 16B. The depth of the gap 30 essentially corresponds to the axial length of the third hole 16C or is even larger, because in this part of the button body 10 the expansion of the wall 28 is expected to be largest.

As shown in FIGS. 1A and 1B, in this embodiment, the wall 28 having a circular tube shape which defines the insert hole 16 therein and a second wall having a circular tube shape which surrounds the wall 28 with the circular-shaped gap 30 therebetween are provided at a lower side of the button body 10. The protrusions 20, 22, 24, 26 are formed on a circular end face of the second wall at a regular interval.

Figure 2A:
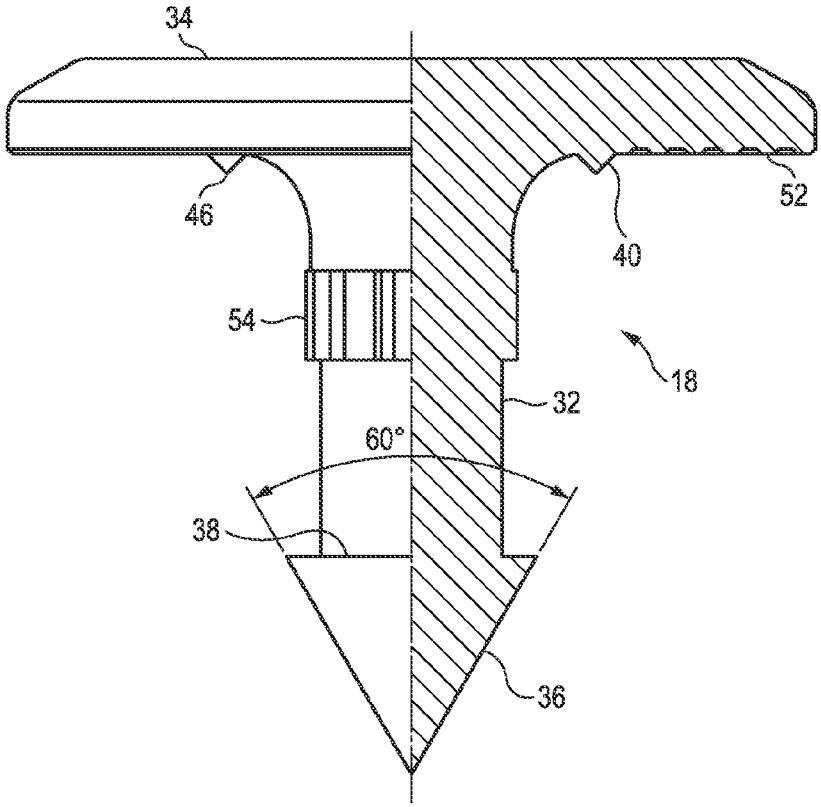
FIG. 2A is a plain view of a fixture adapted to the button body of FIG. 1A.
Figure 2B:
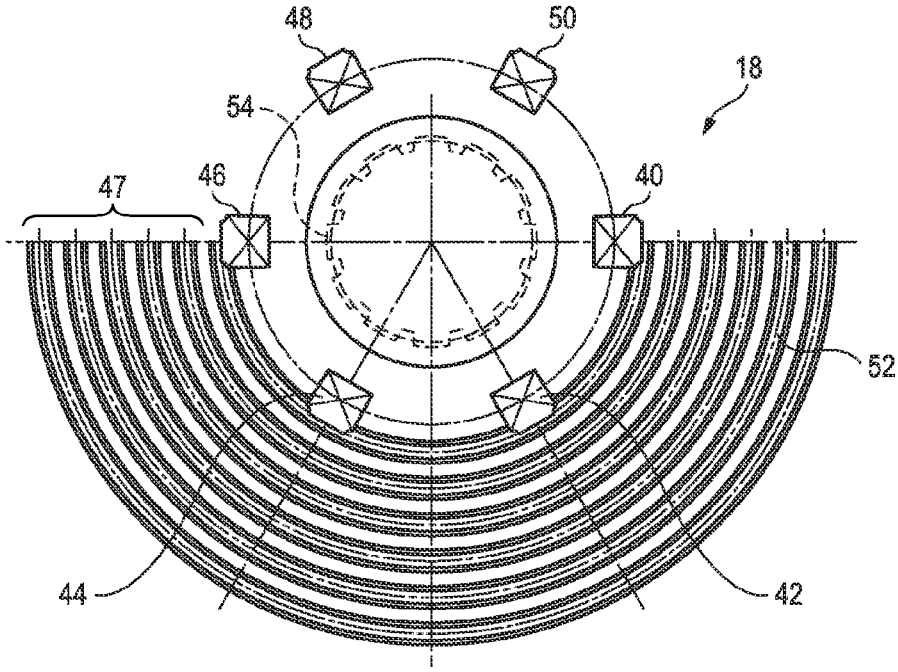
FIG. 2B is a partially cut away side view of the fixture shown in FIG. 2A.

As shown in FIGS. 2A and 2B, fixture 18 includes an insert shaft 32 to be inserted into insert hole 16 of button body 10, and a flange 34 integrally formed on a base end side of insert shaft 32. In this embodiment, fixture 18 is made of metal.

Insert shaft 32 includes a guide part 36 having a conical tip and also having a round cross section perpendicular to a center line of insert shaft 32 and an engagement 38. Insert shaft 32 has an outer diameter that is larger than an inner diameter of second hole 16B of insert hole 16. For instance, when an inner diameter of second hole 16B is 15 mm and an outer diameter of insert shaft 32 is 21 mm, the inner diameter of hole 16B expands by the difference, namely by 6 mm when fixture 18 is mounted to button body 10.

On an inner surface of flange 34, protrusions 40, 42, 44, 46, 48, 50 are formed, each having a form like a quadrangular pyramid, and arranged to cooperate with protrusions 20, 22, 24, 26, respectively, in order to therebetween clasp a support (not shown in the drawings) to which the button is to be fixed. Furthermore, on said inner surface of flange 34 are ring-formed concave-convex portions 47 which are provided concentrically around insert shaft 32, one of which being referred to as number 52. With the configuration as described above, when button body 10 is to be fixed on a support, such as a fabric of a garment, fixture 18 is inserted into insert hole 16 through the fabric from the opposite side from button body 10 with the fabric therebetween. Then, wall 28 is expanded outwards to the outer side.

Figure 3B:
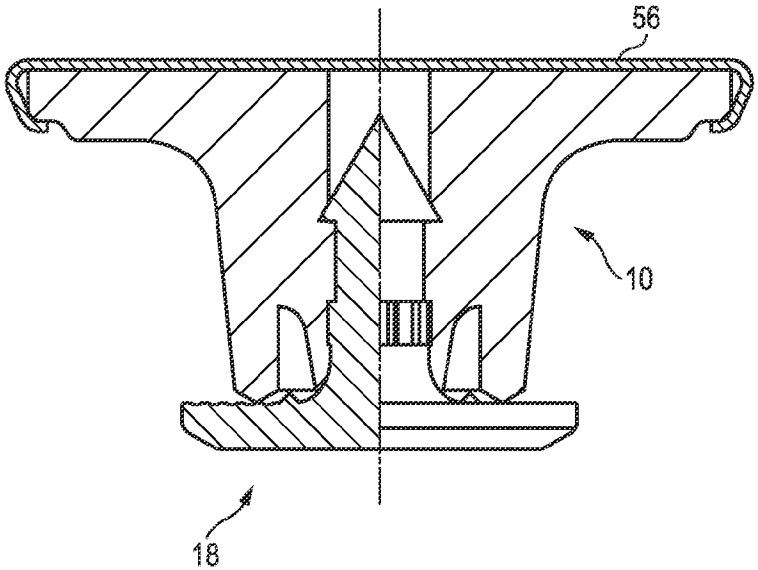
FIG. 3B is a partially cut-away side view of a button according to a preferred embodiment of the invention, after attaching.
Figure 3A:
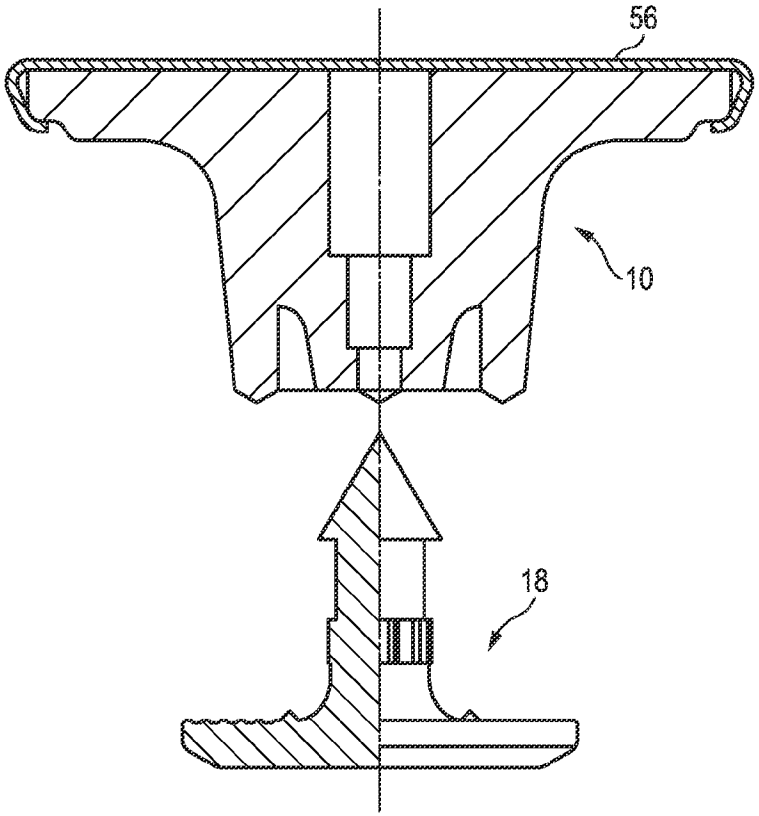
FIG. 3A is a partially cut-away side view of a button according to a preferred embodiment of the invention, before attaching.

In this state, the fabric is held between the protruding end face of wall 28 and the inner surface of flange 34. Furthermore, said protrusions 40, 42, 44, 46, 48, 50 serve for holding said fabric and for preventing lateral or radial movement of fixture 18 relative to button body 10. Said protrusions 40, 42, 44, 46, 48, 50 of the fixture 18 may be positioned radially inside or radially outside said protrusions 20, 22, 24, 26 of the button body 10 when the fixture 18 is mounted in the button body 10. In this embodiment, as shown in FIGS. 3A and 3B, the protrusions 40, 42, 44, 46, 48, 50 are disposed so as to be opposed to the gap 30. That is, the protrusions 40, 42, 44, 46, 48, 50 are positioned radially inside the protrusions 20, 22, 24, 26 of the button body 10.

The button includes a rotation-preventing means for preventing the fixture 18 from rotating relative to the button body 10. The rotation-preventing means may include at least one protrusion. In this embodiment, for example, a plurality of projected treads 54 is provided on the outer peripheral surface of insert shaft 32 with a specified space therebetween along the radial direction of the shaft 32. With this configuration, projected treads 54 crimp into insert hole 16 of button body 10, preventing rotational movement of fixture 18 relative to button body 10. The rotation-preventing means may be a rib.

As shown in FIGS. 3A and 3B, button body 10 can be provided with a cap 56 made of metal. However, this is optional.

The embodiment shown in the drawings and described above is a button for jeans. However, the present invention is not limited to buttons for jeans, but can be used for other supports, such as other types of garments or for other than garments.

It is apparent that many modifications and variations can be made to the button described and illustrated here, all of which come within the scope of the invention, as defined in the attached claims.

The invention claimed is:

1. A button comprising:

a button body; and a fixture for fixing the button body to a support from an opposite side to the button body with the support therebetween, wherein the button body includes a collar, a shaft protruding from the collar and an insert hole for the fixture to be inserted therein, wherein an outer circular wall and an inner circular wall are formed at a lower portion of the button body shaft separately from each other with a gap therebetween, wherein the outer circular wall defines an outer periphery of the shaft and at least one protrusion for fixing the support thereon is formed along the outer circular wall, wherein the inner circular wall defines an inner periphery of the insert hole, wherein the protrusion protrudes relative to the inner circular wall and the gap is recessed relative to the inner circular wall, wherein the insert hole comprises a first part having a first inner diameter, a top edge, and a bottom edge and a second part having a top edge, a bottom edge, and a second inner diameter that is smaller than the first inner diameter, wherein the first part extends from an upper portion of the button body and the second part extends from the bottom edge of the first part to the lower portion of the button body such that a cross section of the insert hole is stepwise increasing from the lower portion of the button body to the upper portion of the button body and such that the fixture is engaged with the button body at the first part of the insert hole, and wherein the gap extends from the lower portion of the button body and wherein a depth of the gap is smaller than an axial length of the second part such that the gap does not extend beyond the top edge of the second part.

2. The button of claim 1, wherein an outer contour of the insert hole defining the inner circular wall is conical in at least one axial section in a direction from the lower side of the button body to the upper side of the button body.

3. The button of claim 1, wherein the protrusion has a circular cross section.

4. The button of claim 1, wherein the protrusion has a conical head portion.

5. The button of claim 1, wherein the fixture has at least one protrusion for fixing the support thereon.

6. The button of claim 5, wherein the protrusion of the fixture has a pyramid form.

7. The button of claim 5, wherein the protrusion of the fixture and the protrusion of the button body cooperate to clasp the support when the fixture is mounted on the button body.

8. The button of claim 5, wherein the protrusion of the fixture is positioned radially inside or radially outside the protrusion of the button body, when the fixture is mounted on the button body.

9. The button of claim 1, further comprising at least one protrusion formed on an outer periphery of a shaft of the fixture.

10. The button of claim 8, wherein the at least one protrusion is a rib or a tread.

11. A button body configured to be fixed to a support by a fixture, the button body comprising:

a collar;

a shaft protruding from the collar; and an insert hole for the fixture to be inserted therein, wherein an outer circular wall and an inner circular wall are formed at a lower portion of the shaft separately from each other with a gap therebetween, wherein the outer circular wall defines an outer periphery of the shaft and at least one protrusion for fixing the support thereon is formed along the outer circular wall, wherein the inner circular wall defines an inner periphery of the insert hole, wherein the protrusion protrudes relative to the inner circular wall and the gap is recessed relative to the inner circular wall, wherein the insert hole comprises a first part having a first inner diameter, a top edge, and a bottom edge and a second part having a top edge, a bottom edge, and a second inner diameter that is smaller than the first inner diameter, wherein the first part extends from an upper portion of the button body and the second part extends from the bottom edge of the first part to the lower portion of the button body such that a cross section of the insert hole is stepwise increasing from the lower portion of the button body to the upper portion of the button body, and such that the fixture is engaged with the button body at the first part of the insert hole, and wherein the gap extends from the lower portion of the button body and wherein a depth of the gap is smaller than an axial length of the second part such that the gap does not extend beyond the top edge of the second part.

12. A button comprising:

a button body; and a fixture for fixing the button body to a support from an opposite side to the button body with the support therebetween, wherein the button body includes a collar, a shaft protruding from the collar and an insert hole for the fixture to be inserted therein, wherein an outer circular wall and an inner circular wall are formed at a lower portion of the button body shaft separately from each other with a gap therebetween, wherein the outer circular wall defines an outer periphery of the shaft and at least one protrusion for fixing the support thereon is formed along the outer circular wall, wherein the inner circular wall defines an inner periphery of the insert hole, wherein the protrusion protrudes relative to the inner circular wall and the gap is recessed relative to the inner circular wall, wherein the insert hole has a first part having a first inner diameter and a second part having a second inner diameter that is smaller than the first inner diameter, wherein the first part extends from an upper portion of the button body and the second part extends from the bottom edge of the first part to the lower portion of the button body such that a cross section of the insert hole is stepwise increasing from the lower portion of the button body facing the support to an upper portion of the button body and such that the fixture is engaged with the button body at the first part of the insert hole, wherein the gap extends from the lower portion of the button body and wherein a depth of the gap is smaller than an axial length of the second part such that the gap does not extend beyond the top edge of the second part, wherein the fixture has at least one protrusion for fixing the support thereon, and wherein the at least one protrusion of the fixture is positioned radially inside the at least one protrusion of the button body and disposed so as to be opposed to the gap.

* * * * *